US005468035A

United States Patent [19]

Fountain

[11] Patent Number: 5,468,035

[45] Date of Patent: Nov. 21, 1995

[54] GRAPPLE HANGER MECHANISM

[76] Inventor: Edward Fountain, 298 Roberts Ave., Yonkers, N.Y. 10703

[21] Appl. No.: 47,978

[22] Filed: Apr. 19, 1993

[51] Int. Cl.[6] ..... B66D 3/00

[52] U.S. Cl. ..... 294/85; 248/228.4

[58] Field of Search ..... 294/19.1, 26, 82.1, 294/82.17, 82.18, 82.19, 82.2, 85; 248/228, 231.5, 340

[56] References Cited

U.S. PATENT DOCUMENTS

| | | | |
|---|---|---|---|
| 1,071,650 | 8/1913 | O'Kelly | 294/82.2 |
| 1,667,927 | 5/1928 | Clarke | 294/82.19 |
| 2,184,812 | 12/1939 | Hendrix | 294/82.17 X |
| 2,462,965 | 3/1949 | Henderson | 294/82.19 |
| 2,961,270 | 11/1960 | Renfroe | 248/228 X |
| 3,044,134 | 7/1962 | Zitney, Jr. | 294/82.19 |
| 3,084,893 | 4/1963 | Ruth | 294/85 X |
| 3,567,169 | 3/1971 | Frederick et al. | 294/85 X |
| 3,632,152 | 1/1972 | Renfroe | 294/85 |
| 5,052,733 | 10/1991 | Cheung et al. | 294/19.1 |

*Primary Examiner*—Dean J. Kramer
*Attorney, Agent, or Firm*—Martin J. Spellman, Jr.

[57] ABSTRACT

A grappling hanging device for attachment to an overhead beam has a primary hanging hook mounted in a frame plate. A rectangular bar extends laterally from the base of the primary hanging hook. The width of the plate is slightly less than a circular area of the keyhole aperture and its thickness slightly less than the spaced walls of the keyhole aperture of the support plate. The opposite end of the support plate has a latching loop extending therefrom. When the lifting force is lowered, the support plate will rotate about the bar in the circular part of the keyhole opening, thereby swinging the opposed latch around to loop over the end of the hook. Once about 180° rotation has occurred, the cross plate will slide to the closed end of the keyhole slot, and lock the hanging mechanism in place.

3 Claims, 8 Drawing Sheets

FIG.2
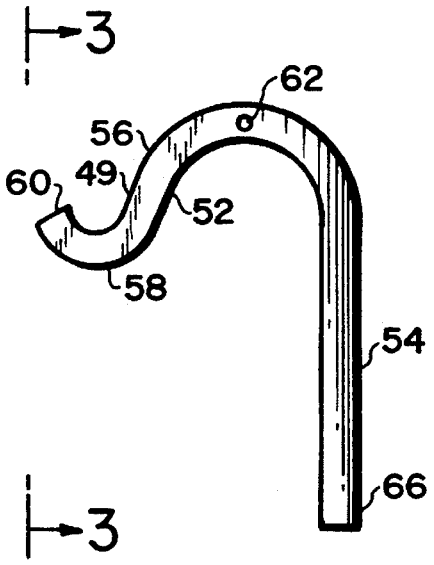
FIG.3
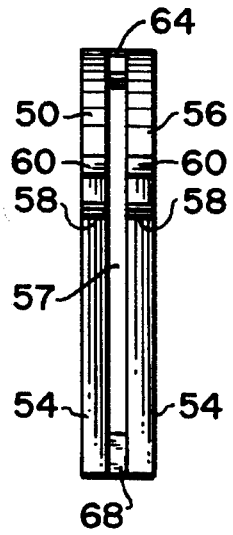
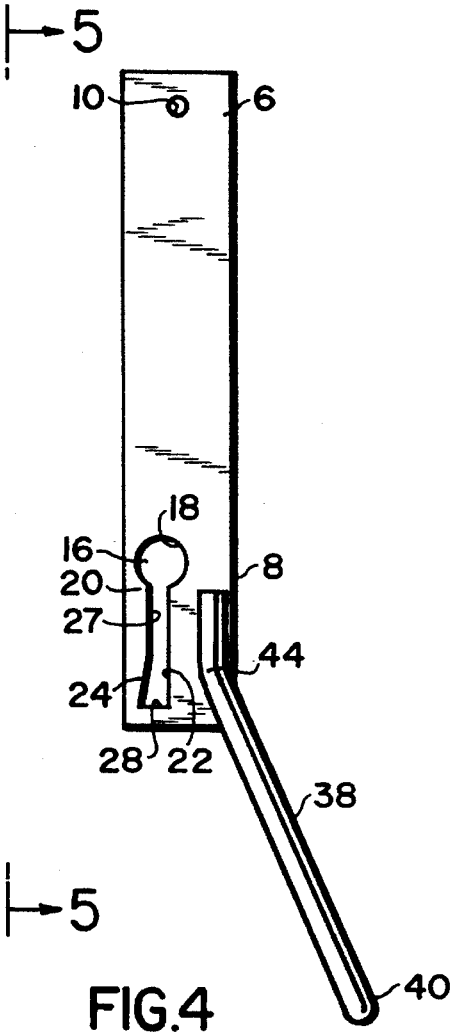
FIG.4
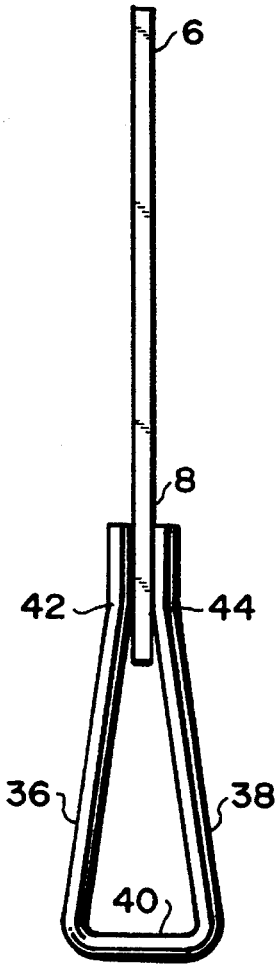
FIG.5

GRAPPLE HANGER MECHANISM

BACKGROUND OF THE INVENTION

1. Field of the Invention

This invention relates to grappling or hanging devices for securing various lifting mechanisms to overhead railings and beams and in this specific case to high beams. It is more specifically concerned with a device which permits the easy securing or placement of a lifting device on an overhead railing or beam without the user physically going up to or touching the overhead beam himself, but permits the device to be safely lifted to the overhead beam and placed thereon by a simple upward and downward motion of an extension pole or its equivalent. Once placed over or hooked to the beam, the device is held securely in place until it is desired to be removed and is easily removed by a simple lifting motion on a portion of the device which will release the secured latching mechanism and let the device be removed without the necessity of the user going up to remove the device. The device is particularly useful in the construction environment where temporary hoisting equipment mechanisms are needed and in theater productions where scenery or special effects must be hung from overhead beams or supports and yet be easily removable.

2. Prior Art

Grappling or hanging devices are known in the prior art, however, Applicant is not aware of any which utilize the approach of the present invention.

Representative of prior art devices used in the past as U.S. Pat. No. 70,239, Melotte issued Oct. 29, 1867 for a grapple. In this case the grapple was raised by placing a shank of the grapple in a socket of a special elevating pole raising it to the beam and then engaging the teeth, the grapple and the rafter by pulling downward on attached tackle and rope. This device is analogous to a ice tong type of arrangement. Various other grappling or hoisting apparatuses designed for suspension from overhead rafters or beams are shown in the following patents which are representative of the prior art in this area.

| | |
|---|---|
| U.S. Pat. No. 70,239 | Melotte |
| U.S. Pat. No. 3,567,169 | Frederick et. al. |
| U.S. Pat. No. 4,382 | Gregory |
| U.S. Pat. No. 57,125 | Gregory |
| U.S. Pat. No. 154,674 | Howland |
| U.S. Pat. No. 189,648 | Pennypacker |
| U.S. Pat. No. 680,322 | Faust |
| U.S. Pat. No. 816,349 | Moore |
| U.S. Pat. No. 1,101,595 | Walles |
| U.S. Pat. No. 1,307,578 | Cherry |
| U.S. Pat. No. 1,990,163 | Blackburn, et. al. |
| U.S. Pat. No. 3,207,463 | Downey |

SUMMARY OF THE INVENTION

The present invention provides a convenient and simple grappling device for readily removably and remotely attaching to an overhead beam or rod.

The grappling device is lifted to the beam and a first hanging hook which is pivotally mounted in a rectangular frame plate of the device is placed over the beam. The first hook has a plate extending laterally from the base thereof which plate extends through a keyhole aperture is one end of the frame plate. The width of the lateral plate is slightly less than a circular area of the keyhole aperture and its thickness slightly less than the spaced walls of the keyhole aperture of the support plate. The opposite or second end of the support plate has a latching loop extending therefrom. When the lifting force is lowered, the support will rotate about the cross plate in the circular part of the keyhole opening, thereby swinging the opposed latch or hook around to loop over the end of the first hook or in an alternative embodiment the end of the second will be opposed to the first hook.

Once about 180 rotation has occurred, the cross plate will slide to the closed end of the keyhole slot, locking the mechanism in place. To remove the device from the beam, the hanging low end of the support is raised to slide the cross plate upwardly in the keyhole slot to the circular opening. The frame bar is rotated swinging the second hook downwardly and the device lifted off the beam.

An aperture at the opposite end of the frame plate provides a means of attaching rigging, scenery etc.

BRIEF DESCRIPTION OF THE DRAWING

In the accompanying drawing which forms a part of this specification:

FIG. 2 is a side plan view of the proportion of the mechanism.

FIG. 3 is a front plan view thereof.

FIG. 4 is a side plan view of support bar and latching loop.

FIG. 5 is a front plan view thereof;

FIG. 14 is a side plan view showing the bar and left loop rotating and; and.

DESCRIPTION OF THE ILLUSTRATIVE EMBODIMENT

The grappling hanger of the present invention is indicated generally in the accompanying drawings by the numeral 2 and comprised is a flat rectangular frame plate 4 for having a first or upper end 6 and a second end or lower end 8.

Figure 1:
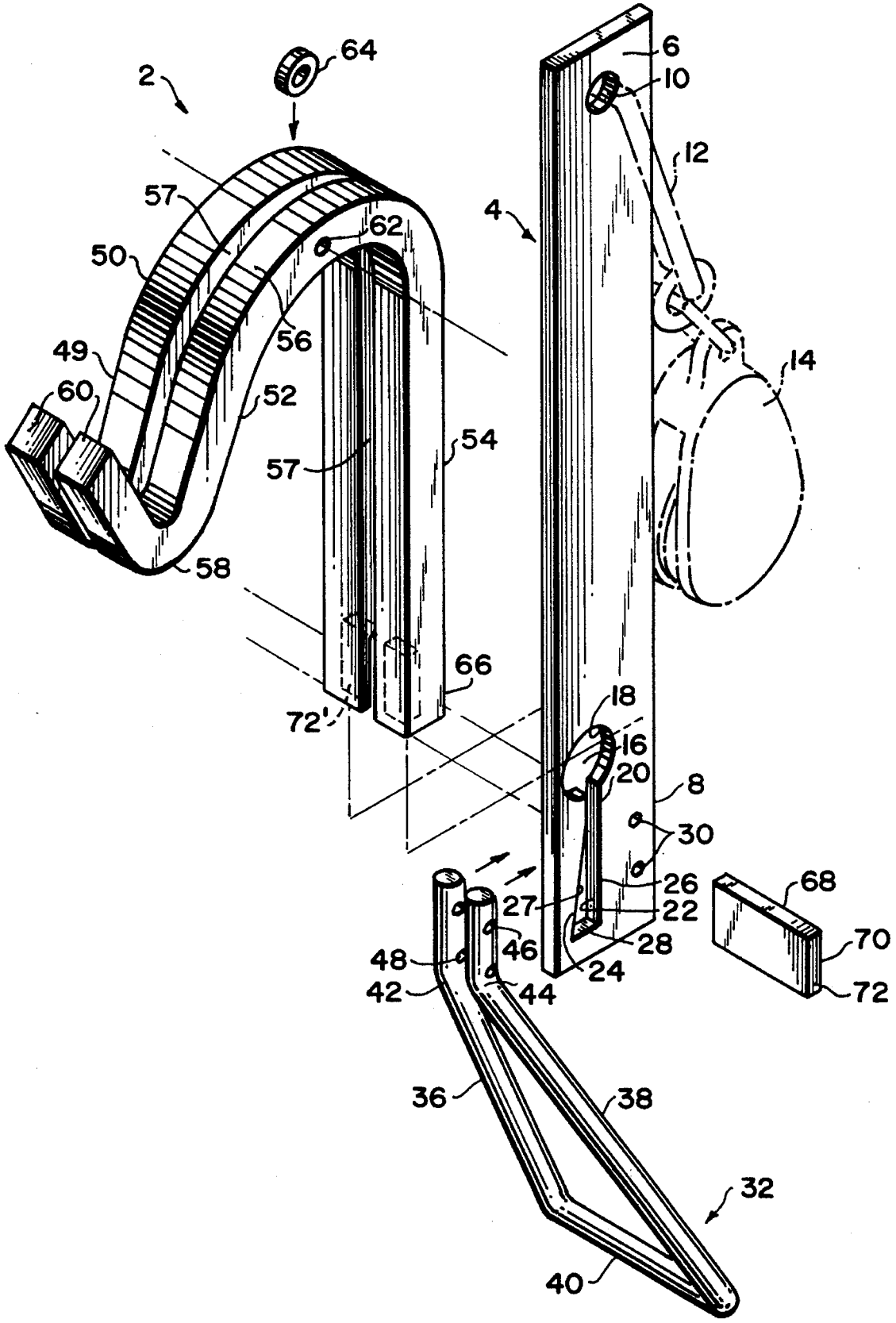
FIG. 1 is a perspective expanded view of the components of the invention with a lifting mechanism for placing the grappling hanger on an overhead beam or rafter.
Figure 6:
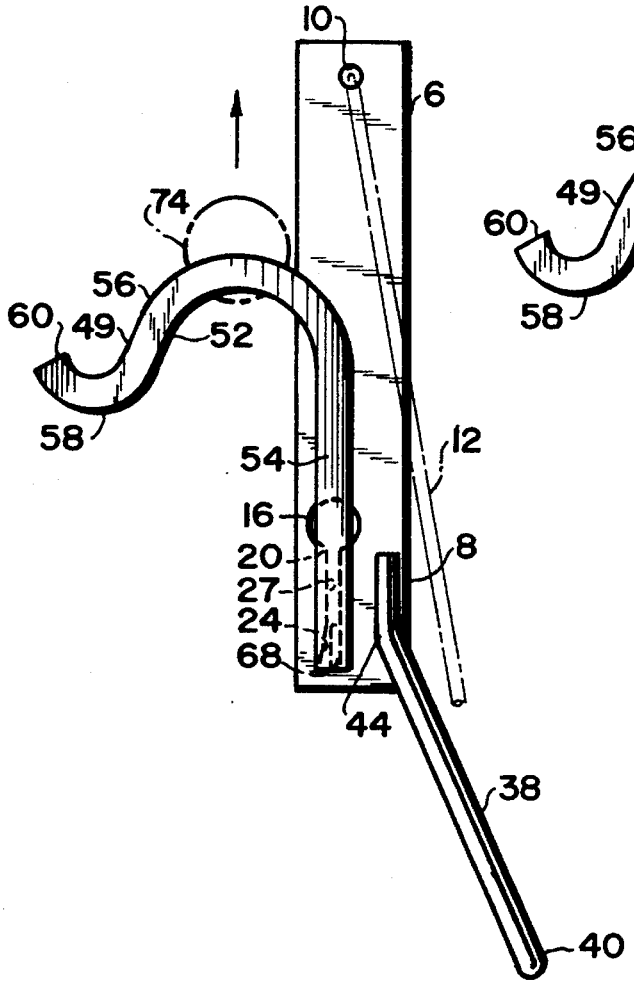
FIG. 6 is a side view of the apparatus being raised and placed over a rafter.

Adjacent to the upper end 6 is an aperture 10 for holding the attachment of a rectangular bracket 12 to which is secured, in the illustration of FIG. 1 to a pulley 14 representing a rigging which can be suspended from the grappling mechanism 2 of the present device and used to lift various things. Other lifting means could be substituted in place of the pulley arrangement 14. In the area of the lower end 8 of the plate 4, there is a key hole shaped opening 16 formed in the plate 4 and comprising an upper circular opening 18, from the lower portion 20 of which extends a slotted length opening 22 having opposed sides 24 and 26 connected at base 28. The lower portion 27 of side 24 is slanted outwardly to facilitate sliding of plate 68 described below.

Apertures 30 are formed along one edge of the lower portion of the plate 4 to connect a latching arm 32.

A latching arm 32 of generally triangular shape, having legs 36 and 38, and a base 40 with the upper ends 42 and 44 of the legs 36 and 38 respectively, spaced slightly apart with apertures 46 and 48 therein, is secured to the plate 4 by bolts (not shown) passing through the apertures 30 in frame plate 4 and the apertures 46 and 48 in the latch arm 34.

A hook 49 is formed by parallel bars 50 and 52, each having an upright or straight dorsal portion 54 curving downwardly, as shown at 56, to an upward by turning bight 58, and terminating in an upward extension 60. Each bar, 50–52, has an aperture 62 therein and the washer 64 is secured between the bars 50 and 52 for spacing purposes by a bolt, not shown, passing through the apertures 62 and the washer 64.

The washer 64 is of a thickness slightly greater than the thickness of the frame plate 4. On the dorsal ends 66 of the bars 54 and 56, there is mounted within recesses 72' a flat connecting plate 68 by screw, rivet, or welding means.

The plate 68 is secured to the bars 50 and 52 so as to maintain their spacing at the lower ends 66 slightly greater than the thickness 72 of the frame bar 4. The length of the sides 70 of the plate 68 is less than the diameter of the circular opening 18 of the keyhole opening 16 in the frame bar 4 so as to permit the plate 68 to rotate within the opening 18 during rotation of the frame bar 4 described below.

The thickness of the bar 68, indicated by 72, is less than the distance between the walls 24 and 26 of the slot opening 22 in the frame bar 4 so as to permit the plate 68 to ride up and down in the slot 22, as well as being able to rotate within the circular opening 18.

Figure 7:
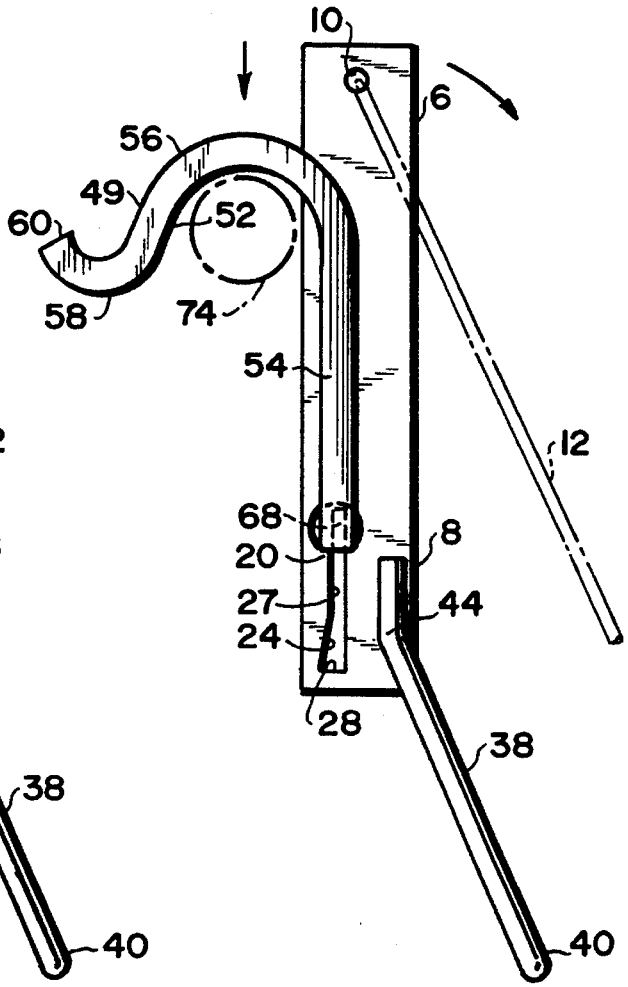
FIG. 7 is a side view of the apparatus having been placed on the rafter and the end of the hanging hook having moved upwardly in the key-holed slot of the support bar.
Figure 8:
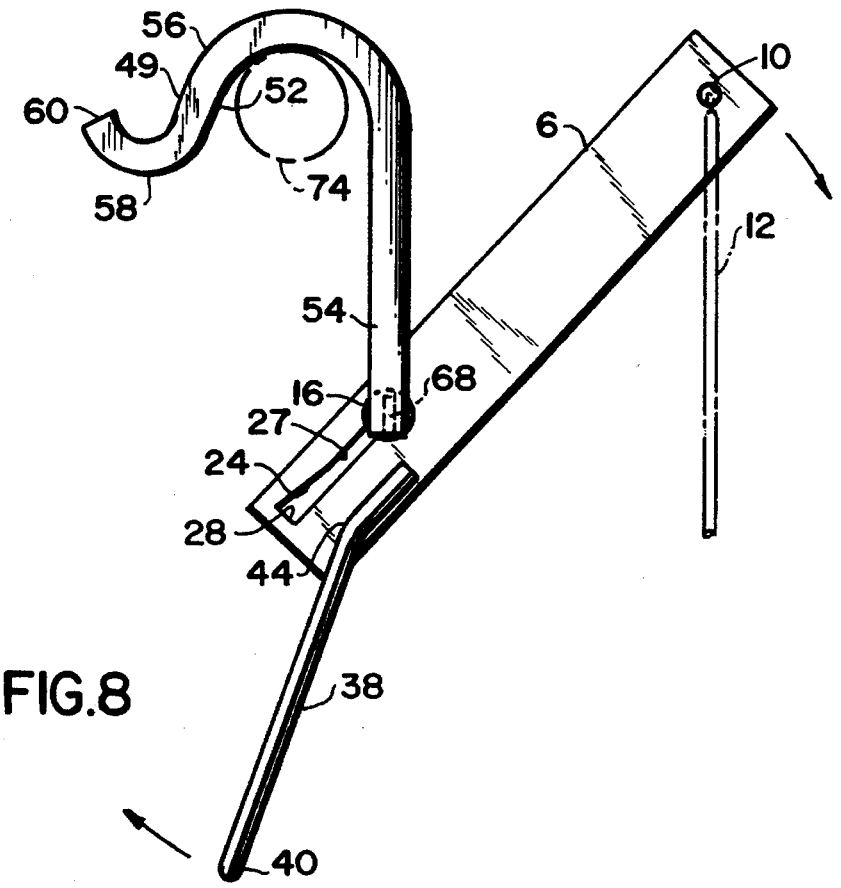
FIG. 8 is a further side view showing the support bar and latching beam rotating about the dorsal end of the hook as the support piece is lowered.
Figure 9:
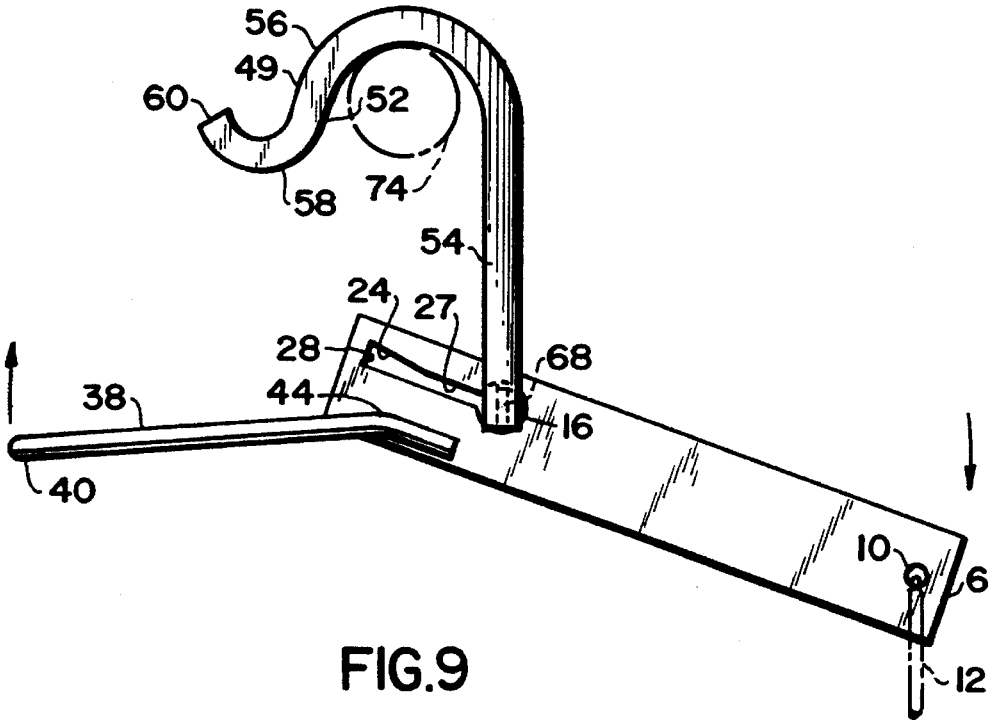
FIG. 9 is a further view as the support bar rotates further.
Figure 10:
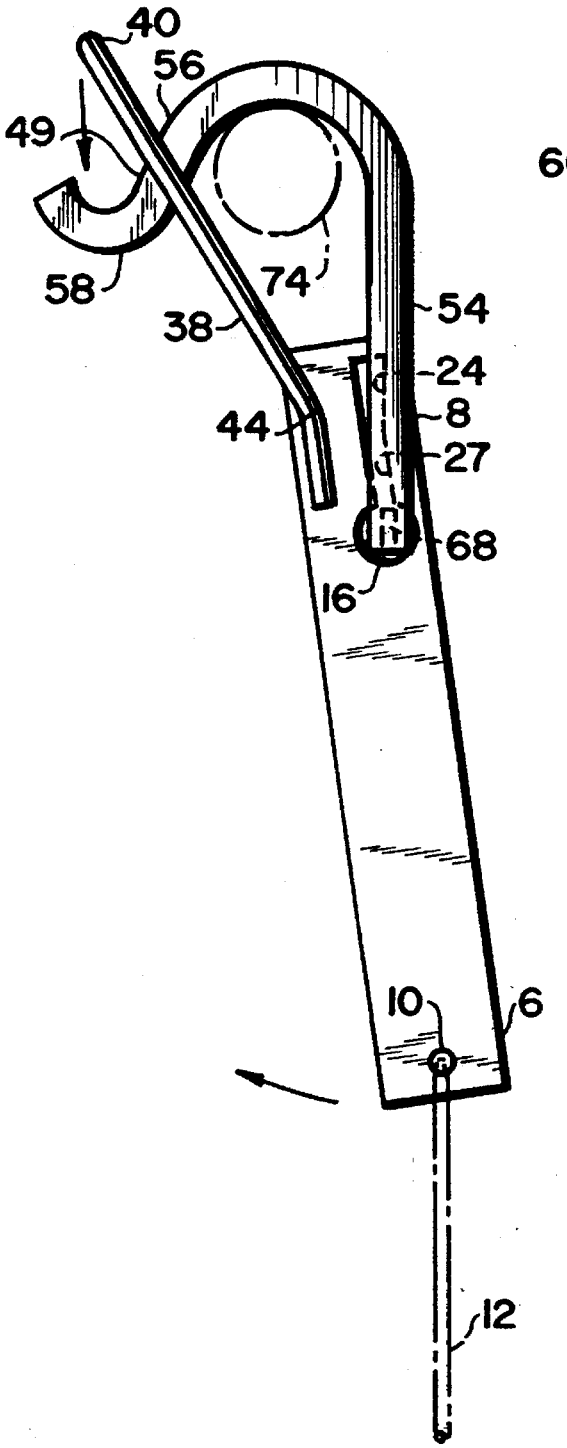
In FIG. 10, the support bar and latching bar have almost completed rotation with the bight of the latching loop having moved over the upward curved end of the hook.

In FIGS. 6–11, the placement of the device 2 on a overhead beam or rail 74 is shown in sequence. Bracket 12 is used to lift the device up to the area of the beam 74 and to place the hook 49 over the beam 74 as shown in sequences of FIGS. 6 and 7. Once the hook 49 is over the bar 74, the device 2 is then lowered as indicated in FIG. 7 and the hook 49 rests on bar 74. The frame plate 4 is then rotated about the plate 68 in the circular opening 18 of 16 as shown in the sequences of FIGS. 7 through 11.

As shown in FIG. 19, latch arm 32 swings over the bend 58 of hook 49 as the frame plate 4 is completing its rotation about the lateral plate 68. The rotation is complete as shown in FIG. 11.

Figure 11:
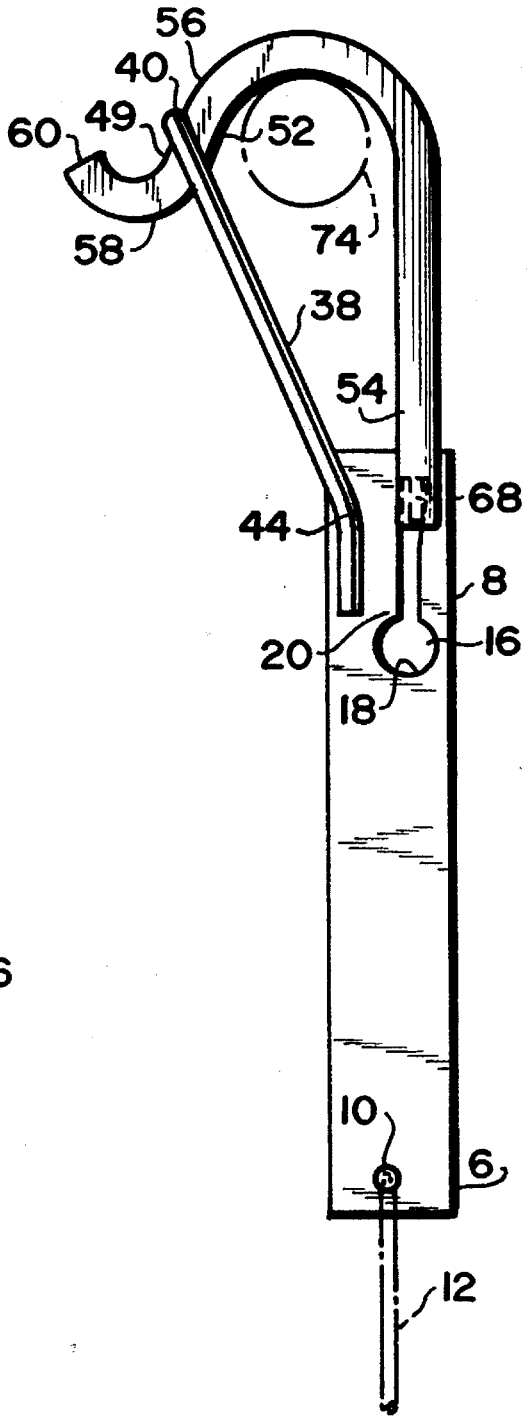
FIG. 11 shows the latch in place over the hook and the end of the bar of hook having slid to the end of the slot of the support bar and the hanging mechanism is firmly in its place.

The lateral plate 68 then slides towards the base 28 of the keyhole slot 22 from the circular opening 18 of key hole opening 16 to the position shown in FIG. 11 with the latch arm 32 then coming down firmly on the bend 58 of the hook 49 and securely holding the device 2 in place. The device 2 cannot be inadvertently knocked off the beam 74 and can only be removed by the reverse motions by which it was hung.

In the alternative embodiment illustrated in FIGS. 12–15, the device of the invention is particularly adapted to be securely suspended from overhead I beams.

Figure 12:
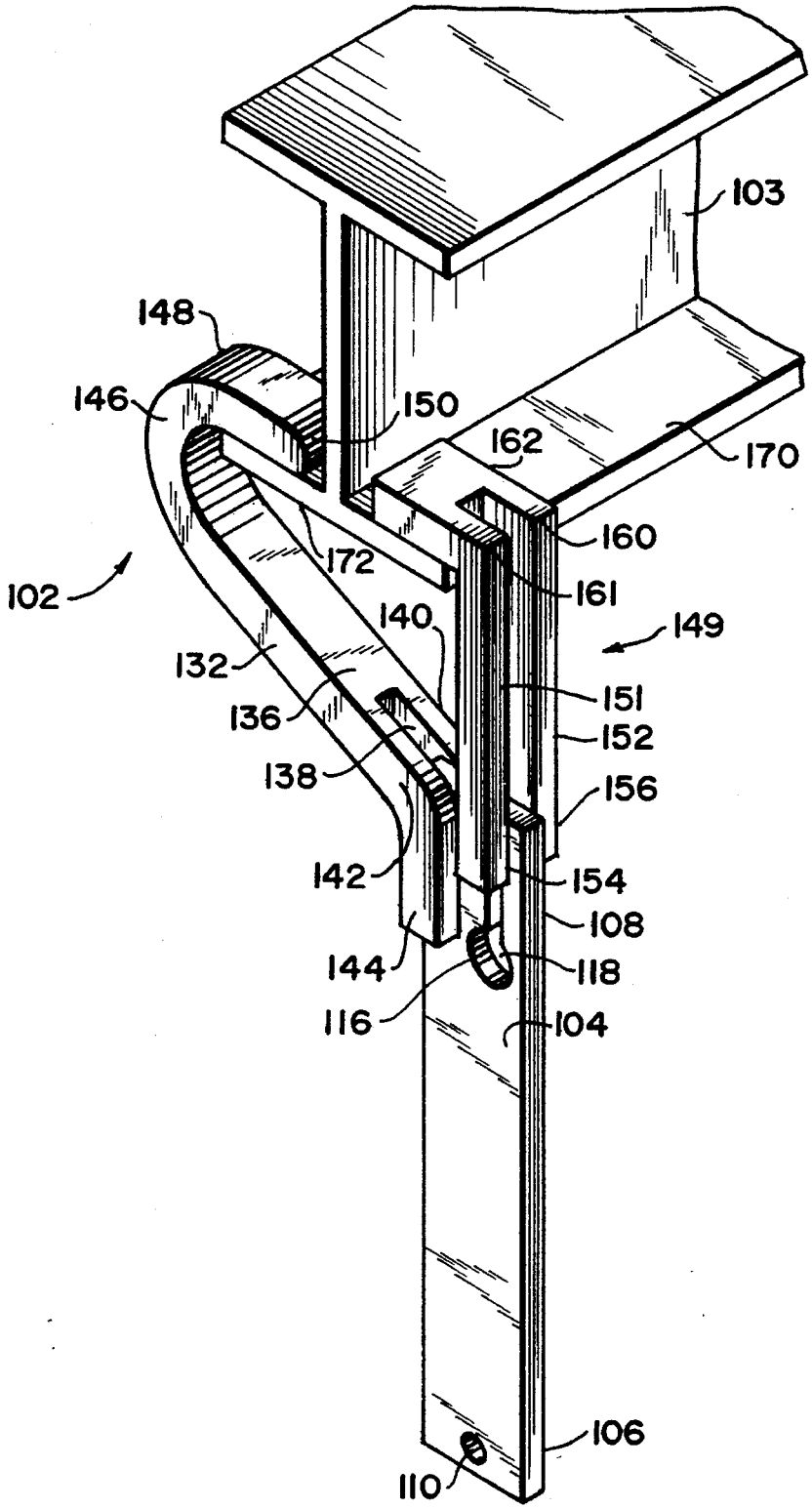
FIG. 12 is a perspective view of a second embodiment of the invention particularly adapted for being secured to I beams.

In FIG. 12, the device 102 is shown in place on the I beam 103. The flat rectangular frame plate 104 has a first end 106 with an aperture 110 and a second end 108. As in the prior embodiment, the second end 108 of the bar 104 has a keyhole shaped opening 116 including the circular area 118 and the slotted portion 120 with sides 124 and 126 and base 128. The lower portion 127 of side 124 diverges outwardly to allow some play between the parts to prevent them locking up.

The latching bar or hook 149 is comprised of a pair laterally spaced parallel legs 151 and 152 which are connected at their free first ends 154 and 156 by a lateral plate 164 that is welded thereto. The width 166 of the plate 164 is slightly less than the diameter of the circular area 118 of the keyhole opening 116 in the frame plate 104. Its thickness 168 is less than the spacing between the sides 124 and 126 of the keyhole opening 116.

The other ends 160 and 161 of the legs 151 and 152 of the bar 149 have right angle extensions 160 and 161 and are joined in common end portion 162.

Extending diagonally outward from the first end 108 of the frame plate 104 is a latching arm 132 which at its inner end 136 is slotted at 138, with the bases 144 of legs 140 and 142 joined as shown by welding to the frame plate 104. The arm 132 turns inwardly at curve 146 to the end extension 148 and end 150 which opposes the end 162 of the hook 149 when in place on the bases and 170 of the I beam 103, respectively.

Figure 13:
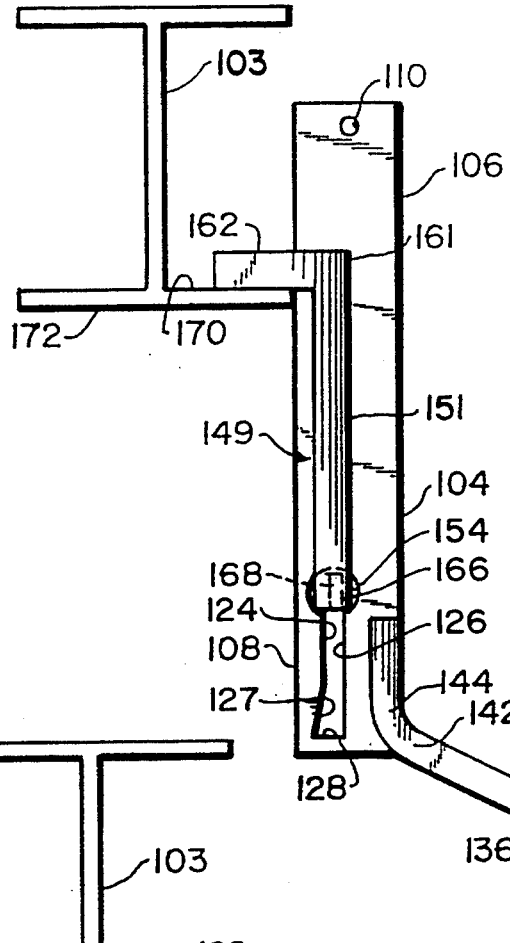
FIG. 13 is a side plan view of this embodiment showing the mechanism in place on one side of the I beam.
Figure 14:
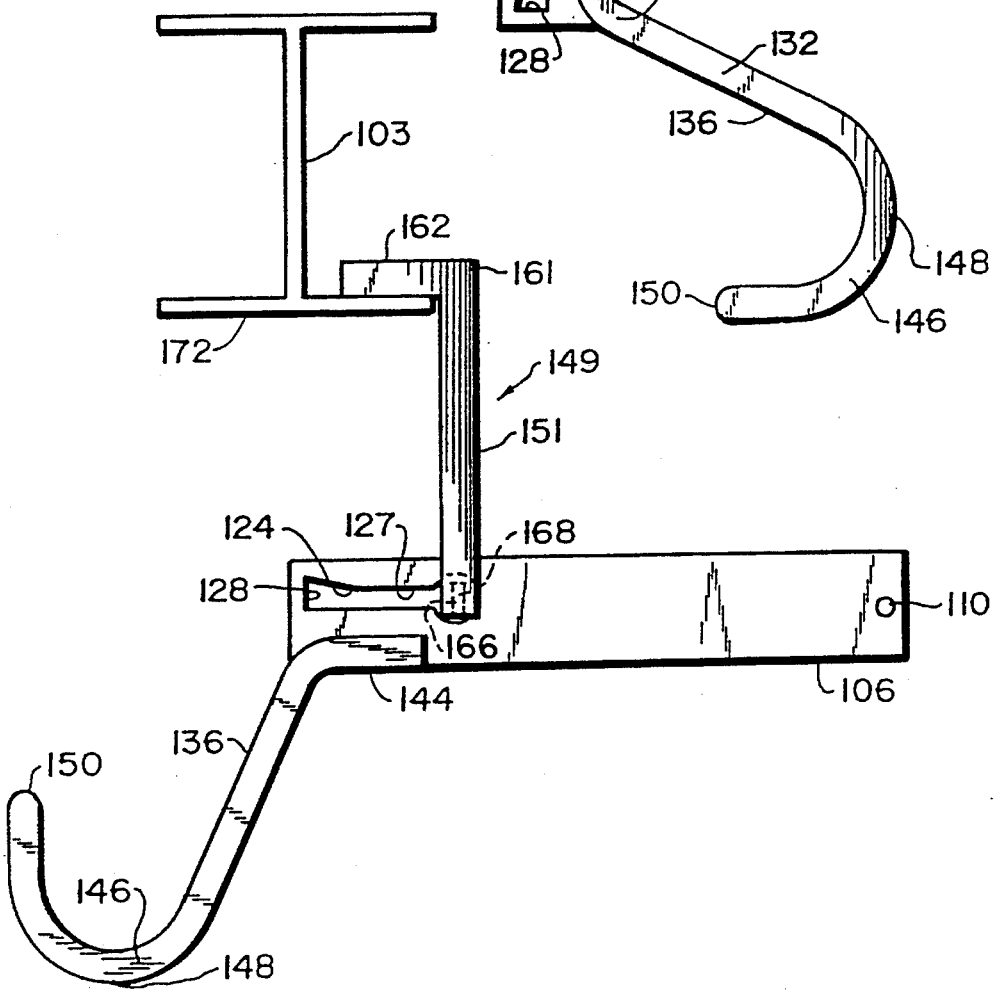

As in the first illustrative embodiment, the grappling hanger 102 is raised to the I beam by lifting at 110 as shown in FIG. 13 with the plate 164 upright in the keyhole slot 116 and the end 162 of the arm 149 resting on the upper surface of the right base 170 of the I beam 103. As the arm 132 is rotated as shown in FIG. 14, the lateral plate 164 rotates within the circular opening 118 of the keyhole opening 116 and the arm 132 swings around towards the opposite side 172 of the I beam 103.

Figure 15:
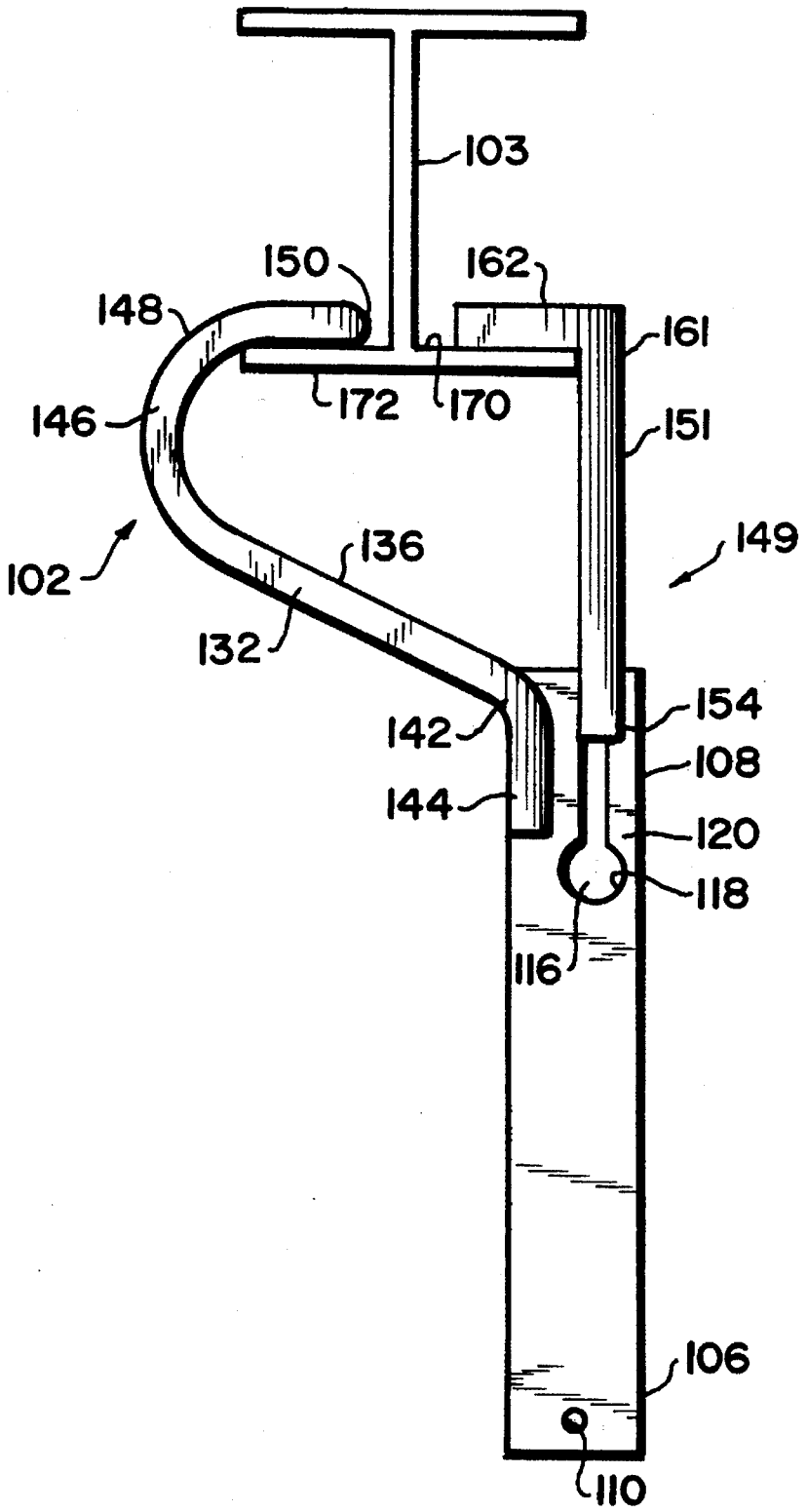
FIG. 15 shows it completely rotated with the pivot portion of the right side having slid upwardly in the key hole slot of the support bar and the opposed hook in place on the other side of the I beam.

Once rotation is completed, the plate 164 slides upwardly in the slot 116 in the frame plate 104 and the end 150 of the hook 132 rests firmly on the left side 172 of the I beam 103 as shown in FIG. 15.

In the appended claims, the term latching means is to be understood to include the latching arm 32 of the first embodiment and the latching arm 132 of the second embodiment.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A grappling hanger device comprising a frame plate, and a first end thereof and a second end thereof, a slotted keyhole aperture in said plate adjacent said second end and including a circular section, a primary grappling hook carried rotably and slidingly in said keyhole opening, said primary grappling hook having a base end, said base end of said grappling hook having a rectangular cross bar sliding in said keyhole opening in said plate, the width of said bar being slightly less than the diameter of said circular section of said keyhole opening and greater than the distance between the walls of the slotted portion of said keyhole opening and the thickness slightly less than the distance between the walls of the slotted portion of said keyhole opening, and latch means fixed to and extending from said second end of said frame plate and lockable over said primary grappling hook, and lifting means at said first end of said frame plate said lifting means being above said primary grappling hook when said primary hook is not latched and below said primary hook when said primary hook is latched, said frame plate rotating about 180° around said cross bar, and said lifting means moveable to and from above said hook in the unlatched state and to and from below said hook in the latched state.

2. A grappling hanger device comprising a frame plate, and a first end thereof and a second end thereof, a slotted keyhole aperture in said plate adjacent said second end and including a circular section, a primary grappling hook carried rotably and slidingly in said keyhole opening said primary grappling hook having a base end, said base end of said primary grappling hook having a rectangular cross bar sliding in said keyhole opening in said plate, the width of said bar being slightly less than the diameter of said circular section of said keyhole opening and greater than the distance between the walls of the slotted portion of said keyhole opening and the thickness slightly less than the distance between the walls of the slotted portion of said keyhole opening, said hook having a reverse turn at the end thereof, and latch means comprising a secondary grappling hook fixed to and extending from said second end of said frame plate and opposable to said primary grappling hook said lifting means being above said primary grappling hook when said primary hook is not latched and below said primary hook when said primary hook is latched, said frame plate rotating about 180° around said cross bar, and said lifting means moveable to and from above said primary hook in the unlatched state and to and from below said hook in the latched state.

3. A grappling hanger device comprising a frame plate, and a first end thereof and a second end thereof, a slotted keyhole aperture in said plate adjacent said second end and including a circular section, a primary grappling hook carried rotably and slidingly in said keyhole opening, said primary grappling hook having a base end, said base end of said grappling hook having a rectangular cross bar sliding in said keyhole opening in said plate, the width of said bar being slightly less than the diameter of said circular section of said keyhole opening and greater than the distance between the walls of the slotted portion of said keyhole opening and the thickness slightly less than the distance between the walls of the slotted portion of said keyhole opening, said hook having a reverse turn at the end thereof and latch means fixed to and extending from said second end of said frame plate and lifting means at the said first end of said frame plate said lifting means being above said primary grappling hook when said primary hook is not latched and below said primary hook when said primary hook is latched, said frame plate rotating about 180° around said cross bar and said lifting means moveable to and from above said primary hook in the unlatched state and to and from below said hook in the latched state.

* * * * *